United States Patent [19]

Saito et al.

[11] 4,449,623

[45] May 22, 1984

[54] PASSENGER CONVEYOR BALUSTRADE

[75] Inventors: Chuichi Saito; Katsuya Teranishi; Katsuyoshi Baba; Yoshihiro Osumi, all of Katsuta, Japan

[73] Assignee: Hitachi, Ltd., Tokyo, Japan

[21] Appl. No.: 465,619

[22] Filed: Feb. 10, 1983

Related U.S. Application Data

[63] Continuation of Ser. No. 84,593, Oct. 15, 1979, abandoned, which is a continuation of Ser. No. 848,327, Nov. 3, 1977, abandoned.

[30] Foreign Application Priority Data

Nov. 12, 1976 [JP] Japan ..... 51-135399

[51] Int. Cl.[3] ..... B66B 9/14

[52] U.S. Cl. ..... 198/335; 198/337; 72/701

[58] Field of Search ..... 198/335, 336, 337, 338; 104/25; 72/701

[56] References Cited

U.S. PATENT DOCUMENTS

| | | | |
|---|---|---|---|
| 2,780,338 | 2/1957 | Tilton | 198/337 |
| 3,321,059 | 5/1967 | Kroepel | 198/335 |
| 3,353,650 | 11/1967 | Schroeder et al. | 198/335 |
| 3,442,367 | 5/1969 | Van Voorhis | 198/335 |
| 3,568,813 | 3/1971 | Schaeffer | 198/335 |
| 4,273,232 | 6/1981 | Saito et al. | 198/335 |

*Primary Examiner*—Jeffrey V. Nase

*Attorney, Agent, or Firm*—Antonelli, Terry & Wands

[57] ABSTRACT

A balustrade for use with passenger conveyors including a second deck member bent to assume an arcuate shape at landings, and having a U-shaped cross-section adapted to be opened facing the center of the arc, and deformation preventing strips formed by bending the second deck member adjacent its opening which defines an inner periphery of the arcuate-shaped sections of the second deck member.

1 Claim, 10 Drawing Figures

PASSENGER CONVEYOR BALUSTRADE

This is a continuation of application Ser. No. 84,593, filed Oct. 15, 1979, now abandoned, which was a continuation of application Ser. No. 848,327, filed Nov. 3, 1977, now abandoned.

LIST OF PRIOR ART REFERENCE (37CFR 1.56 (a))

U.S. Pat. No. 3,321,059 Knoepel May 23, 1967, 198-16
U.S. Pat. No. 3,353,650 Schroeder et al Nov. 21, 1967 198-16

BACKGROUND OF THE INVENTION

1. Field of the Invention

This invention relates to a balustrade for use with passenger conveyors such as escalators, electrically operated passageways and the like and, more particularly, to a balustrade which is formed of stainless steel sheets.

2. Description of the Prior Art

Passenger conveyors have spread widely as fixtures which are indispensable to a building as a means for satisfying the needs of persons who utilize the building. In recent years, a variety of demands have been put forward for industrial designs of balustrades. As is well known, the balustrade constitutes a major part of a designed body in the passenger conveyor, and it is generally recognized by the parties concerned that whether the balustrade has an attractive industrial design or not is a major selling point in respect of making a discrimination among room designs.

As described in U.S. Pat. Nos. 3,321,059 and 3,353,650, the balustrade includes stationary members except for an endless series of steps adapted to convey passengers thereon, and moving parts such as handrails. As described above, each balustrade includes, as main components thereof, a main deck member upon which handrail is mounted, a lower deck member and a glass panel, all of which constitute an object for industrial design. It is conventional to form the main and lower deck members by extruded material of aluminum alloy, of which surfaces have been subjected to alumite treatment.

Aluminum alloy material has been widely used for the main and lower deck members of a balustrade since it is advantageous in its formability into substantially complex shapes. However, the use of this material has a disadvantage in that the manufacturing cost thereof continues to be increased due to high electric power consumption and the raw material therefor tends to be reduced. However, what is more significant than the high manufacturing cost is the fact that aluminum alloy material is relatively soft (as compared to such metallic materials as steel) to be readily marred. This presents a serious problem in which the respective members of balustrade present scratches and impressions on the inner sides thereof facing the steps after the members have been contacted by a large number of passengers during several years of operation. Thus such passenger conveyors present an unsightly appearance. Particularly in the case of passenger conveyors installed in underground markets, corrosion of the material of the balustrades caused by underground water adds to deterioration of the industrial design of the balustrades.

Therefore, stainless steel sheets have begun to be used in place of aluminum alloy material, which sheets are superior to the latter in price stabilization, hardness and anticorrosive resistance. However, the use of stainless steel for balustrades raises the technical problem of the material being deformed when worked to bend the same. Since this problem has not been solved satisfactorily, the practice of using a stainless steel sheet has not yet become popular.

SUMMARY OF THE INVENTION

It is an object of the present invention to provide a balustrade for passenger conveyors which is highly productive and obviates the aforementioned problem of deformation upon bending.

The object of the present invention can be accomplished by a balustrade for use with passenger conveyors including a handrail guide for guiding a handrail adapted to be moved in synchronism with a endless series of steps, a first deck member and a second deck member connected to the first deck member and having a U-shaped cross-section with its opening facing the opposite side of the handrail, each of said first and second deck members being bent to assume an arcuate shape at landings, the improvement comprising deformation preventing strips provided adjacent the opening about the arcuate-shaped sections of the second deck member and bent inwardly.

DESCRIPTION OF THE PREFERRED EMBODIMENTS

Figure 1:
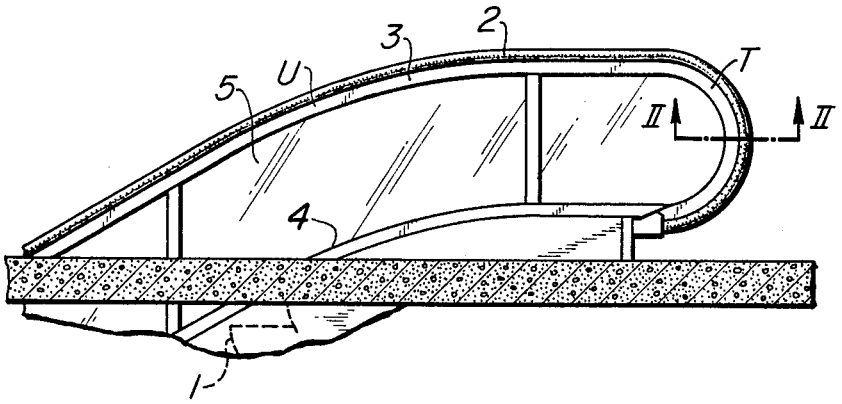
FIG. 1 is a side elevational view of a portion of a passenger conveyor adjacent an upper landing.

As shown in FIG. 1, the passenger conveyor comprises balustrades each including stationary members except for an endless series of steps 1 adapted to convey passengers thereon, and a handrail 2 disposed above the steps. The stationary members comprise mainly a main deck member 3 for supporting the handrail 2, a lower deck member 4 and a balustrade glass panel 5, all of which are objects of industrial design. A material for balustrades is, first of all, required to have a good bending workability since the contour of balustrade consists of concave or U-shaped curve, T-shaped terminal curve and unique, streamlined arc.

Figure 2:
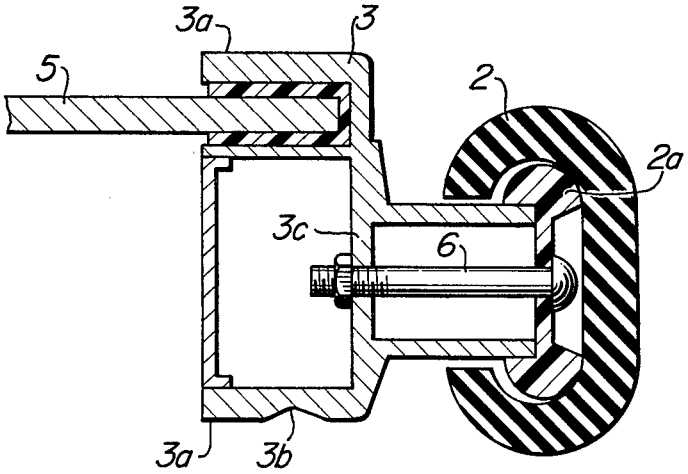
FIG. 2 PRIOR ART
FIG. 2 is a sectional view taken along the line II—II in FIG. 1, showing a prior balustrade having deck members made of aluminum alloy material.

Referring now to FIG. 2, the prior main deck member 3 made of aluminum alloy has a glass panel 5' fitted thereinto at the lower portion thereof and has a guide 2a secured thereto at the upper end portion thereof by means of bolts 6, which guide guides the handrail 2. The configuration in section of the main deck member 3 is conventionally determined such that portions of the main deck member 3 are thickened at areas where wrinkles tend to be produced (as at 3a in FIG. 2), are thinned at areas where wrinkles are hard to be produced (as at 3c in FIG. 2), and are in the form of decorative line (3b). In the prior art, attempts have been made to meet the requirements of compensating for the lack of workability of the material and increasing the attractiveness of the decorative design as aforementioned.

Figure 3:
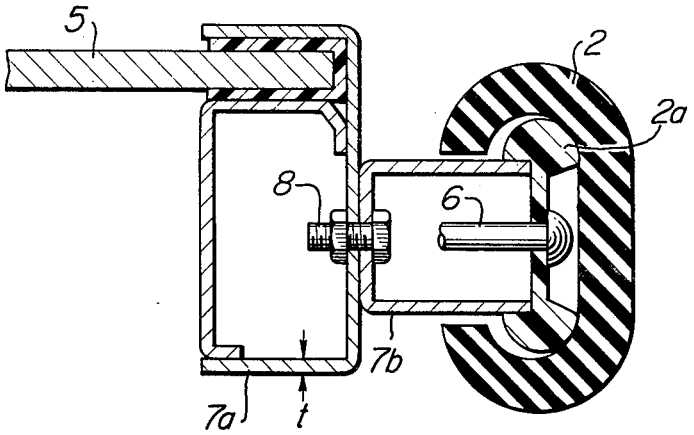
FIG. 3 PRIOR ART
FIG. 3 is a sectional view similar to FIG. 2 but showing a prior balustrade having deck members made of stainless steel.
Figure 4:
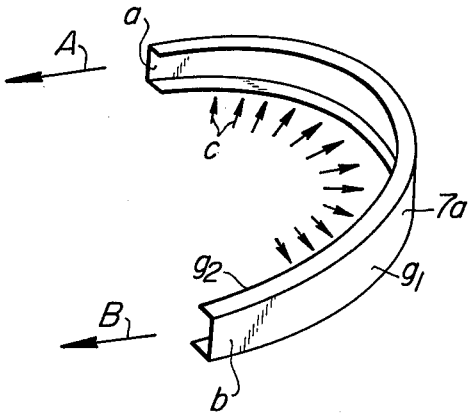
FIG. 4 to FIG. 7 are views showing a deck member of stainless steel being subject to bending, FIG. 4 showing the member being exerted by tensile forces, FIG. 5 showing the manner in which various forces act on the member, and FIGS. 6 and 7 showing the manner in which the member is deformed.

In FIG. 3, there is shown a main deck member formed of stainless steel which have come to attract attention in recent years. A thin sheet of 1 to 3 millimeter in thickness t is subject to bending by means of a press brake to provide a main deck member having a desired cross-sectional shape. Therefore, it is conventional neither to provide any variation in thickness of the material nor to provide a decorative line. As it is, the main deck member 3 is produced by separately forming a first U-shaped deck portion or member 7a and a second U-shaped deck portion or member 7b, and then secure them together by means of bolts 8 when assembled.

Although the deck portions or members 7a and 7b lack variety in industrial design (such as the use of a decorative line) and it is troublesome to join the two deck portions or members 7a, 7b together by means of bolts, there has been an increasing demand for deck members made of stainless steel because they are resistant to scratches, are highly durable, and present deep gloss thereon which is favored by many people.

The manner in which a balustrade deck member made of stainless steel are subjected to bending will now be described by referring to the deck member 7a by way of illustration.

Figure 5:
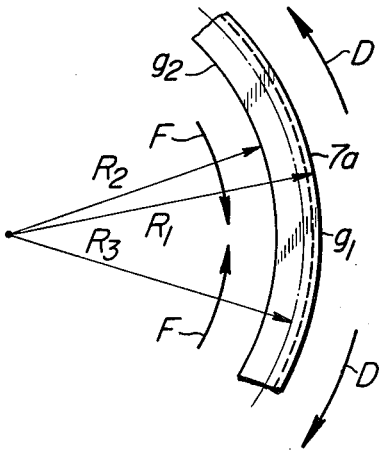
Figure 6:
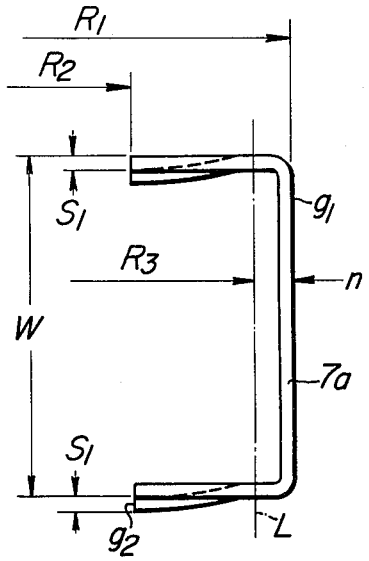

As shown in FIGS. 4 to 7, opposite end portions a and b are subject to tension in the directions of arrows A and B with the deck member 7a faced inwardly, so that an outer peripheral surface $g_1$ may have radius or curvature $R_1$ and an inner peripheral surface $g_2$ may have radius of curvature $R_2$. In this case, reaction forces against the tensile forces in the directions of arrows A and B are distributed over substantially all the area of the inner peripheral portion as designated by an arrows c, and the outer peripheral surface $g_1$ is elongated as indicated by the arrows D. As a result, the portion of the deck member 7a disposed inwardly of a neutral axis L, as shown in FIG. 6, begins to contract as indicated by an arrows F (FIG. 5). Such phenomenon is physically natural, but causes disadvantages as presently to be described when this type of thin stainless steel sheet is bent.

Figure 7:
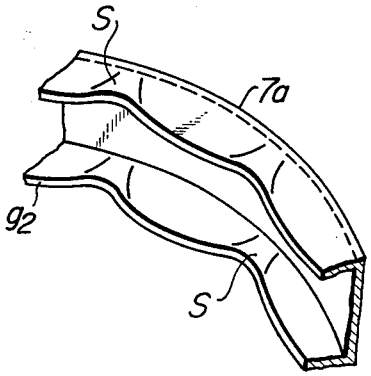

More specifically, the aforementioned contraction indicated by arrows F manifests itself as large wrinkles on the inner peripheral surfaces $g_2$, as shown in FIG. 7. Therefore, the flange portions of the deck member 7a extending over a width of W are displaced laterally a distance $S_1$ (FIG. 6). It will be appreciated that much work is required to correct the deformation of the deck member 7a into a regular shape. The wrinkles S are, of course, greatly related to the position of the neutral axis L from the viewpoint of strength of materials, and can not be avoided due to the shape of the deck member 7a, as shown in FIG. 6, in which the neutral axis L is spaced a short distance n from the outer peripheral surface $g_1$ and a radius of curvature R3 at the neutral axis L is close to radius of curvature R1 ($>R3 \approx R2$) of the outer peripheral surface $g_1$. Therefore, it will be apparent that in order to eliminate wrinkles S or displacement $S_1$, the neutral axis L should be positioned near the inner peripheral surface $g_2$ where wrinkles tend to occur.

As an alternative measure for preventing wrinkles S from being produced, that portion of the deck member 7a which may produce wrinkles can be thickened so as to absorb wrinkles therein, as shown in FIG. 2. However, such measure cannot go well in cases where stainless steel sheets of a uniform thickness are subject to bending to form deck members 7a. Thus, their has been a significant problem in the preventing of wrinkles in balustrades made of stainless steel.

Figure 8:
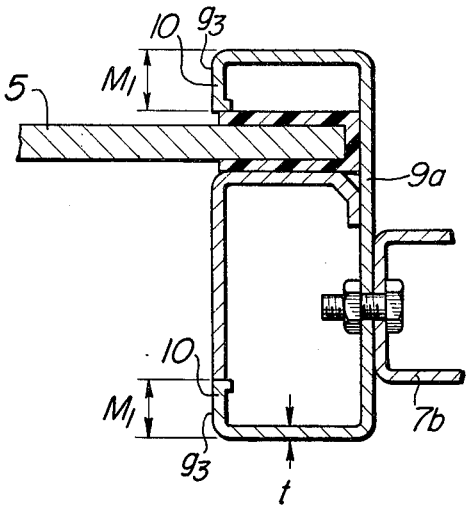
FIG. 8 is a sectional view similar to FIG. 2, but showing a balustrade having deck members made of stainless steel according to one embodiment of the invention.
Figure 9:
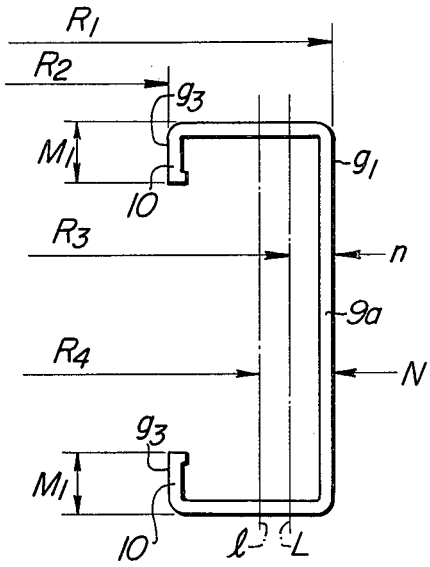
FIG. 9 is a detailed view showing the essential part of the balustrade shown in FIG. 8.

FIGS. 8 and 9 show one embodiment of the invention. In the drawings, a handrail (not shown) and a balustrade glass panel 5 are similar in construction to those of the prior balustrade. According to the present invention, a deck member 9a is substantially U-shaped in cross section and includes deformation preventing plates 10, each of which extends a distance $M_1$ inwardly along an inner peripheral surface $g_3$ (corresponding to $g_2$ of the prior deck member). The deformation preventing plates 10 are formed upon bending in a press brake when a stainless steel sheet is formed into a substantially U-shaped body. The distance over which each deformation preventing plate 10 extends along the surface $g_3$ is 1.5 or more, preferably 2 to 4 times the thickness t of the sheet. The deformation preventing plates 10 increase the flexural rigidity of the inner peripheral surface $g_3$ (as seen from FIG. 9, the cross-sectional area of the inner peripheral surface portion $g_3$ is greater than that of the inner peripheral surface portion $g_2$ in FIG. 6), and the neutral axis l is displaced substantially toward the inner peripheral surface $g_3$ to be positioned a distance N from the outer peripheral surface $g_1$ where N is larger than n ($N>n$), and the radius of curvature is R4 at the position of the neutral axis l. ($R1-R4 \approx N$). It will be apparent that wrinkles are difficult to be produced. In addition, the inner peripheral surface portion $g_3$ is increased in flexural rigidity to be effective in eliminating wrinkles.

From the foregoing description, it will be appreciated that the present invention provides deck members which facilitate bending work and facilitate production thereof. Moreover, the invention is advantageous in that problems associated with scratches and corrosion can be solved so as to render a passenger conveyor durable.

Figure 10:
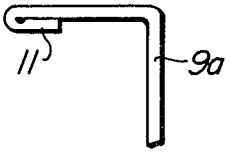
FIG. 10 is an exploded, detailed view similar to FIG. 9 but showing the essential part of another embodiment of the invention.

It is to be understood that the invention is not limited to the specific shape of the deformation preventing plate of the deck member shown and described hereinabove. For example, the plate may assume the shape as at 11 in FIG. 10, in which the plate is turned down to be brought into contact with the flange portion of the deck member 9a. The invention essentially resides in the provision of a deck member which is U-shaped in section and is provided at the inner peripheral surface thereof with deformation preventing plates. The shape and the width of the deformation preventing plate may be selected as desired. The deformation preventing plate can be applied to the deck member as illustrated, but also to all the members adapted to be subject to bending work. The material used for forming the deck members of the balustrade is not limited to stainless steel sheets, but may be common steel sheets.

What is claimed is:

1. In a balustrade for use with passenger conveyors including a handrail guide for guiding a handrail adapted to be moved in synchronism with an endless series of steps, a first stainless steel deck member and a second stainless steel deck member connected to the first deck member, each deck member having a U-shaped cross-section with an opening thereof facing an opposite side of the handrail, each of said first and second deck members being bent to have arcuate-shaped sections at landings of the conveyors, the improvement comprising deformation preventing strips for preventing creation of wrinkles and deformations in the stainless steel in an area of the arcuate-shaped sections, the deformation preventing strips are provided adjacent the opening about the arcuate-shaped sections of the deck members and bent inwardly, wherein each of said deformation preventing strips is formed such that it projects from the deck member for a distance which is over 1.5 times the thickness of the deck member.

* * * * *